United States Patent [19]

Crisp

[11] 4,102,634

[45] Jul. 25, 1978

[54] FLOATING WICK HOLDER

[75] Inventor: David Crisp, London, England

[73] Assignee: Rizla Limited, Wales Wales

[21] Appl. No.: 770,842

[22] Filed: Feb. 22, 1977

Related U.S. Application Data

[63] Continuation-in-part of Ser. No. 445,951, Feb. 26, 1974, abandoned.

[30] Foreign Application Priority Data

Feb. 26, 1973 [GB] United Kingdom ..... 9447/73

[51] Int. Cl.[2] ..... F23D 3/02

[52] U.S. Cl. ..... 431/298; 431/320

[58] Field of Search ..... 431/298, 291, 320, 126

[56] References Cited

U.S. PATENT DOCUMENTS

| | | | |
|---|---|---|---|
| 3,183,688 | 5/1965 | Sobelson | 431/126 |
| 3,434,789 | 3/1969 | Haller | 431/126 |

FOREIGN PATENT DOCUMENTS

| | | | |
|---|---|---|---|
| 34,832 | 8/1885 | Fed. Rep. of Germany. | |
| 1,077,163 | 3/1960 | Fed. Rep. of Germany | 431/298 |
| 1,380,358 | 1/1975 | United Kingdom. | |

*Primary Examiner*—Carroll B. Dority, Jr.

*Attorney, Agent, or Firm*—Wender, Murase & White

[57] ABSTRACT

A lamp comprising a wick-holder moulded in one piece from poly-4-methylpent-1-ene or like plastics material which is naturally buoyant upon combustible oil and which includes a central wick-retaining recess, a peripheral portion disposed above the recess, and at least one arm linking said recess to said peripheral portion and disposed below the peripheral portion. In use the lamp holder floats in oil with the central wick-retaining recess and the or each arm submerged and with only the peripheral portion floating.

3 Claims, 12 Drawing Figures

FIG. 3
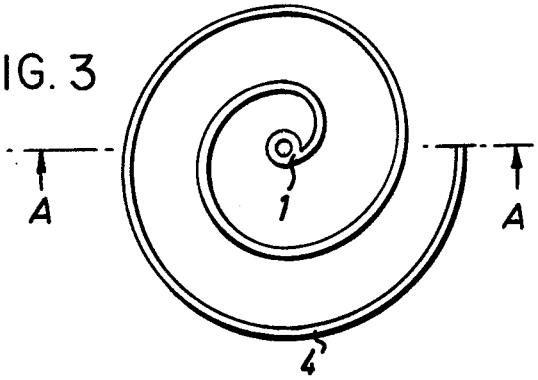
FIG. 3A
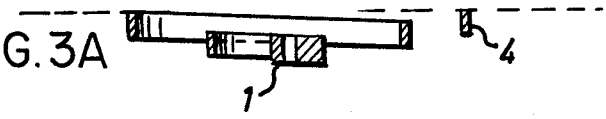
FIG. 4
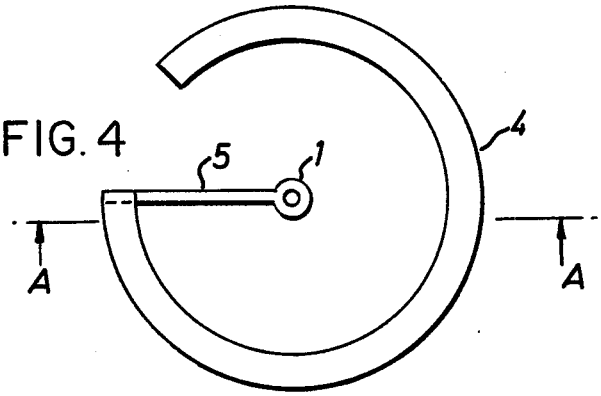
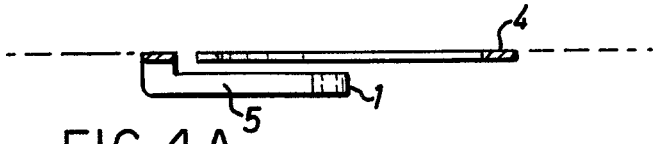
FIG. 4A

FLOATING WICK HOLDER

CROSS-REFERENCE TO RELATED APPLICATION

The present application is a continuation-in-part of copending application Ser. No. 445,951 filed Feb. 26th, 1974, and now abandoned.

BACKGROUND OF THE INVENTION

This invention relates to a floating wick-holder which in use floats upon a body of combustible oil.

It has hitherto been known to make floating wick-holders by injection moulding from a single sheet of plastics material and to provide air-containing buoyancy chambers to enable the holder to float.

U.S. Pat. No. 3,183,688 (Sobelson) is an example of a wick-holder of the kind referred to above. It is a disc-like body formed from a single sheet of plastics material. It consists of a central wick support, a circular well portion defined by the inner surface of an annular rib, and an annular flotation portion defined between an outer wall of the wick-holder and the outer surface of the annular rib. The Sobelson wick-holder suffers from the disadvantages that in use the inner surface of the annular rib is in direct contact with the hot liquid in the well portion and that the upper bight portion of the annular rib is clear of the surface of the liquid and is exposed to the flame from the wick which is relatively close thereto. The annular flotation portion is open to the upperside and is liable to fill with liquid if the surface of the liquid is disturbed mechanically or by air currents with the result that the member can easily be made to sink. Furthermore, Sobelson is restricted to wick-holders of circular shape whereas consumers often desire more decorative shapes.

German DAS 1 077163 (Glafey) shows a flower-shaped wick-holder in which a plurality of petal members are fixed around a circular stamen portion containing a wick support. Each petal has an internal flotation cavity open to the underside thereof. In use the Glafey wick-holder floats with the stamen portion submerged. Although the idea of providing buoyancy by means of air trapped in flotation cavities beneath the wick-holder reduces the risk of the wick-holder sinking, there is still a risk of it doing so, and more importantly the requirement for flotation cavities imposes a practical lower limit on the size of the petals. Thus the Glafey wick-holder cannot be used to reproduce flower shapes or complex abstract shapes consisting wholly of fine filaments because flotation cavities have to be provided.

Another construction of wick-holder described in British patent specification No. 1,380,358 issued to RIZLA LIMITED consists of an imperforate, circular, one-piece, thin-walled member of a plastics material such as cellulose acetate, P.V.C. polystyrene or polypropylene, the member having a wall thickness of between 0.01 and 0.02 and preferably 0.015 inches. It is illustrated in FIGS. 5 and 6 which are plan and cross-sectional views of an embodiment of the wick-holder described in the said British patent.

In the device shown in FIGS. 5 and 6, the member 10 is moulded or vacuum-formed so as to have four portions 30 which define segmental flotation cavities opening to the underside of the member and separated by a flat area 20 which is cruciform in plan and which is below the level of the rims of the portions 30. When the member is set upon the surface 50 of a body of combustible oil, on which the member is caused to float because of the buoyancy-imparting effect of air trapped in the cavities 30, oil flows over the flat area to feed a wick W. The wick is supported in a recess within a tube 40 which projects down from the underside of the flat area and is located at the centre of the member. In use, the body of oil is supported on a non-flammable liquid such as water so that when the oil is exhausted the water floods over the flat area and extinguishes the wick. Because buoyancy is imparted to the member by trapped air there is again a reduced but not negligible chance of the member capsizing. More importantly the fact that the wick-holder is formed from a single circular sheet and the requirement for buoyancy chambers precludes the use of complex and artistically desirable shapes.

SUMMARY OF THE INVENTION

It is an object of this invention to provide wick-holders of plastics materials which can be made in a wide range of complex shapes and which do not require the provision of flotation chambers.

It is also an object of this invention to provide wick-holders which can be formed entirely from thin rigid strips or filaments of plastics material.

A further object of this invention is to provide a floating wick-holder which although formed from a plastics material is not liable to ignite or distort when the wick is alight or sink in the body of combustible oil if the surface of the latter is accidentally disturbed, and is suitable for manufacture by injection moulding.

Accordingly, the invention provides a wick-holder which is moulded in one piece from poly-4-methylpent-1-ene or similar plastics material which is naturally buoyant in a combustible oil, such as vegetable oil, the wick-holder having a central wick-retaining recess which in use is disposed beneath the surface of a body of combustible oil when the wick-holder is set down thereupon. Poly-4-methylpent-1-ene is the full chemical name of the material commonly referred to in the art as "polymethylpentene". To achieve this desired floating condition, the wick-retaining recess is arranged at a level slightly below the peripheral portion of the wick-holder which is in contact with the surface when the wick-holder is floating. The peripheral portion of the wick-holder is joined to the wick-retaining recess by an arm disposed below the peripheral portion whereby in use the arm is submerged in the combustible oil. The recess for receiving the wick may be a through-hole or a blind hole, or may be formed by a tubular extension projecting up or down from the wick supporting portion.

It is important to bear in mind that the candle holder does not float in water but in a layer of combustible oil which is less dense than water. Most plastics materials commonly used in injection moulding such as polystyrene, cellulose acetate or polypropylene are more dense than combustible oils and therefore require flotation chambers to be provided if they are to be used as floating wick-holders. For this reason flotation chambers have been used for a considerable time despite their disadvantage and despite the limitation which they place on the range of designs in which a floating candle can be made. Surprisingly, however, there is a plastics material available, poly-4-methylpent-1-ene, which has a sufficiently low density to enable it to be naturally buoyant in combustible oils. It is a comparatively high-melting material (MP = 240° C) and its main field of application has been in the fabrication of shields for refrigerator light bulbs and the like products where a combination of transparency with good resistance to heat distortion is required. It was developed in the 1960's by Imperial Chemical Industries, was first marketed as long ago as 1965 by I.C.I. on a semi-commercial scale and its uses were reviewed by Rudolph D. Deanin, Society of Plastics Engineers Journal, 23 (2), 39–42 (1967). It has almost the minimum density for a thermoplastic material as appears from the following table taken from page 17 of "Polyolefin Plastics" by Theodore O. J. Kresser, Van Nostrand Reinhold Company, 1969:

TABLE

| Material | | Density |
|---|---|---|
| Polyethylene - | Low density | 0.91 - 0.925 |
| | Medium density | 0.926 - 0.94 |
| | Linear | 0.94 - 0.965 |
| Polypropylene - | Homopolymer | 0.902 - 0.906 |
| | Copolymers | 0.890 - 0.905 |
| | Impact | 0.90 - 0.91 |
| Polybut-1-ene | | 0.91 - 0.915 |
| Poly-4-methyl-pent-1-ene | | 0.83 |
| Ethyl vinyl acetate copolymers | | 0.92 - 0.95 |

Despite its advantageous properties and low density, poly-4-methylpent-1ene has remained a comparatively small scale product and it is not mentioned except very briefly in the standard textbooks on plastics materials. It is not a well-known material. The sole supplier listed for the U.S.A. in 1975 was the Mitsui Petroleum Company of Japan. The applicant herein is not aware of any publication or use of poly-4-methylpent-1-ene which takes advantage of its exceptionally low density or which takes advantage of its ability to float on combustible oil.

As mentioned above poly-4-methylpent-1-ene is the only thermoplastic material which now exists which has a sufficiently low density to be used in this invention, but it is possible (though not likely) that other similar low-density materials may later be invented.

BRIEF DESCRIPTION OF THE DRAWINGS

FIG. 3 is a plan view of a further embodiment of a floating wick-holder according to the present invention;

FIG. 3A is a sectional view taken along line A—A of FIG. 3;

FIG. 4 is a plan view of a further embodiment of a floating wick-holder according to the present invention;

FIG. 4A is a sectional view taken along line A—A of FIG. 4;

Referring to FIG. 1, a floating wick-holder is in the form of a one-piece member injection moulded from poly-4-methylpent-1-ene. The member has a central portion 1 formed with a through-opening 2 in which a wick 3 may be retained, and six disc-like main float portions 4 each of which is joined to the central portion by a respective one of six radiating arms 5. The main float portions 4 are located at a level higher than the upper surface of the central portion 1 so that when the member is set down the surface of a body of combustible oil, such as vegetable oil, the portions 4 float in the surface (indicated by broken line) and the portion 1 is beneath the surface. Consequently, there is no risk of the member coming into contact with the flame when the wick is alight. To prevent damage to the member when the supply of oil is nearly exhausted, it is preferred for the oil to be floated on the surface of a body of water which extinguishes the wick when the oil supply has been consumed.

Figure 1:
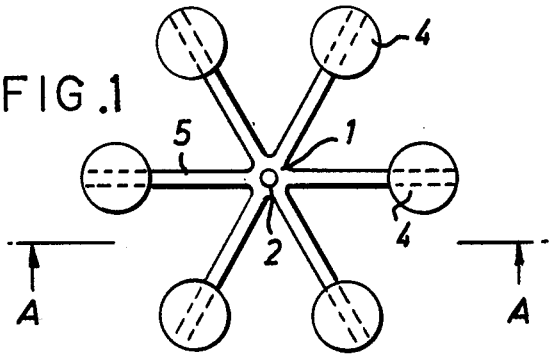
FIG. 1 is a plan view of a first embodiment of a floating wick-holder in accordance with the present invention.
Figure 1A:
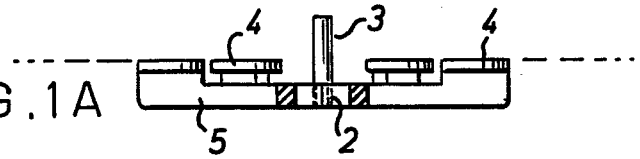
FIG. 1A is a sectional view taken along line A—A of FIG. 1.
Figure 2:
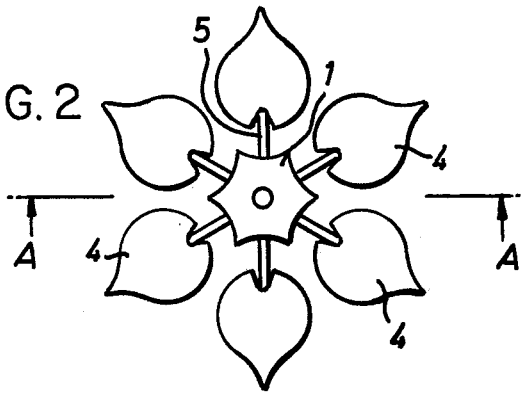
FIG. 2 is a plan view of another embodiment of a floating wick-holder in accordance with the present invention.
Figure 2A:
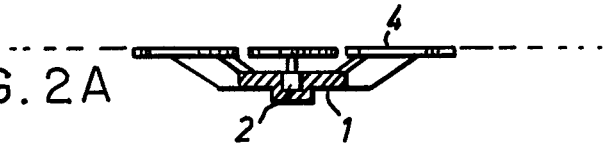
FIG. 2A is a sectional view taken along line A—A of FIG. 2.
Figure 5:
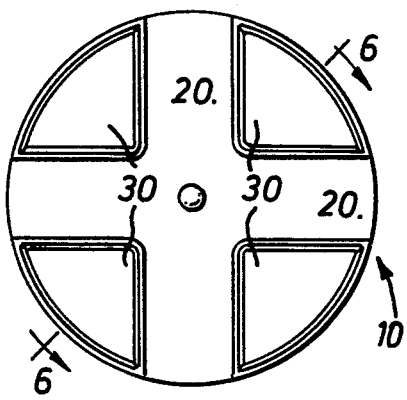
FIG. 5 is a plan view of a prior art wick-holder.

The embodiment shown in FIG. 2 is similar to that of FIG. 1, but the central and main float portions 1 and 4 have a shape such that, overall, the member has a floral appearance. In addition, the recess 2 for the wick is formed as a blind hole.

In the case of the embodiment shown in FIG. 3, the member is formed as a spiral the hub 1 of which constitutes the wick supporting portion, while the turns 4 serve as the main float portion. Over at least a part of their overall length, the turns of the spiral form a spiral-helix so that when floated on oil the wick supporting portion and the inner turns lie below the surface of the liquid.

The embodiment shown in FIG. 4 is similar to that of FIG. 3 but has a part annular main float portion 4. A wick supporting portion 1 is joined to the portion 4 by a single radial arm 5 which, together with the portion 1, lies beneath the plane of the portion 4.

Modifications may of course be made to this embodiment it being possible to make the part 4 as a complete annulus and/or provide more than one arm 5.

Figure 7:
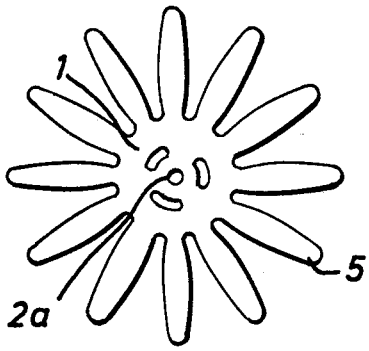
PRIOR ART FIG. 7
FIG. 7 is a plan view of a yet further embodiment of a floating wick-holder according to the present invention.
Figure 6:
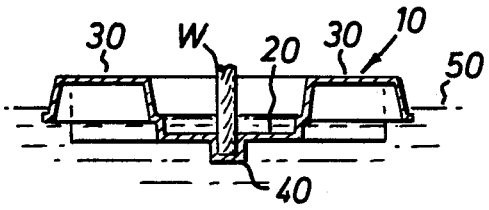
FIG. 6 is a sectional view taken along line 6—6 of FIG. 5.
Figure 8:
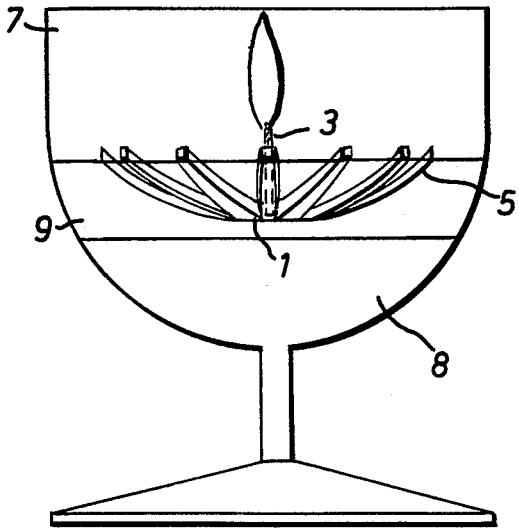
PRIOR ART FIG. 8
FIG. 8 is a side elevational view of a lamp including a floating wick-holder according to the present invention.

The embodiment shown in FIG. 7 is similar to that of FIG. 1 except that the float pads 4 have been omitted and the number of radiating arms 5 has been increased. The central portion 1 is formed with a blind recess 2*a* in its upper surface for supporting a wick and the arms extend radially therefrom to give a daisy or ox-eye appearance. The float pad is dished with a concave upper surface as is more clearly seen in FIG. 8 which shows the wick-holder of FIG. 7 in use in a lamp for table decoration. FIG. 8 shows a glass 7 containing a body of water 8 on which floats a relatively thin layer 9 of a combustible oil such as corn oil. The wick holder floats in the oil with its central portion 1 submerged but with a vertically disposed wick 3 protruding above the surface of the oil and with the radiating arms 5 submerged in the oil except for their ends which contact the surface.

All of the embodiments of the wick holder described above, as well as others not disclosed but still making use of the same basic principle, are particularly suited to manufacture from plastics by injection moulding techniques.

I claim:

1. A floating wick-holder for a lamp, said wick-holder being molded in one piece from a plastic material which has a density less than that of combustible oil and is naturally buoyant thereon, said wick-holder including a central portion defining a generally cylindrical hole for directly receiving and retaining a wick, a peripheral portion disposed around the central portion and offset axially therefrom, and at least one arm linking the central portion to the peripheral portion, the volume of said central portion relative to the entire volume of said wick-holder being such that said portion will displace less weight of oil than the total weight of said wick-holder causing said central portion and at least part of said linking arm to sink below the surface when said wick-holder is placed in oil thereby to preclude flame damage to said wick-holder when the wick is ignited.

2. A wick-holder according to claim 1, wherein the plastic material is poly-4-methylpent-1-ene.

3. A lamp comprising in combination:

a body of water;

a layer of combustible oil floating on said body of water, and a wick-holder moulded in one-piece from poly-4-methylpent-1-ene floating by means of natural buoyancy in said layer of combustible oil with a central wick-retaining recess portion submerged in said oil layer and containing a vertically disposed wick protruding above the surface of said oil layer, a peripheral portion of said wick-holder contacting the surface of said layer of oil, and an arm submerged in said oil layer linking said central recess portion to said peripheral portion.

* * * * *